United States Patent [19]

Muzslay

[11] Patent Number: 4,820,199

[45] Date of Patent: Apr. 11, 1989

[54] ELECTRICAL CONNECTOR ADAPTER

[75] Inventor: Steven Z. Muzslay, Huntington Beach, Calif.

[73] Assignee: ITT Corporation, New York, N.Y.

[21] Appl. No.: 135,889

[22] Filed: Dec. 21, 1987

[51] Int. Cl.[4] ..... H01R 13/40

[52] U.S. Cl. ..... 439/599; 439/81; 439/405

[58] Field of Search ..... 439/597-600, 439/603, 628, 630, 632, 638, 640, 655, 721, 723, 724, 405, 418, 81

[56] References Cited

U.S. PATENT DOCUMENTS

| | | | |
|---|---|---|---|
| 3,486,163 | 12/1969 | De Vuyst et al. | 439/638 |
| 3,990,767 | 11/1976 | Narozny | 339/198 |
| 4,417,780 | 12/1983 | Knapp | 439/405 |
| 4,464,002 | 8/1984 | Suzuki et al. | 339/97 |
| 4,555,153 | 11/1985 | Bricaud et al. | 439/81 |
| 4,611,880 | 9/1986 | Petersen et al. | 439/599 |

FOREIGN PATENT DOCUMENTS

| | | |
|---|---|---|
| 2083295 | 3/1982 | United Kingdom . |
| 2167912 | 6/1986 | United Kingdom . |

*Primary Examiner*—Paula A. Austin

*Attorney, Agent, or Firm*—Thomas L. Peterson

[57] ABSTRACT

An electrical connector adapter is disclosed having front and rear insulators with corresponding contact cavities therein which are slightly laterally offset from each other. The contacts have intermediate bendable portions. One of the insulators is formed of a resilient material. After one end of the contacts are mounted in the other insulator, the contact cavities in the resilient insulator are expanded to slidably receive the other ends of the contacts therein. The expansive force is then released causing the resilient insulator to contract around the contacts therein to automatically bend the intermediate portions of the contacts to accommodate for the lateral offset of the contact cavities in the front and rear insulators.

15 Claims, 5 Drawing Sheets

FIG. 5
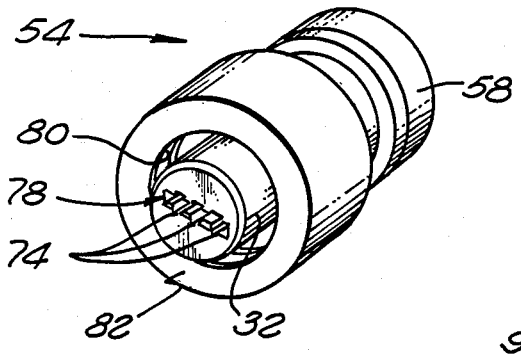
FIG. 6
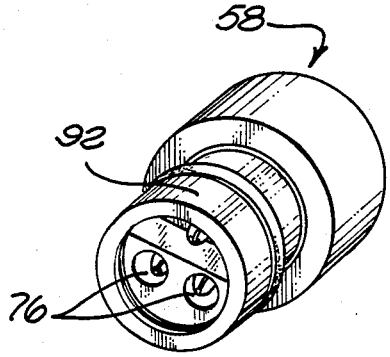
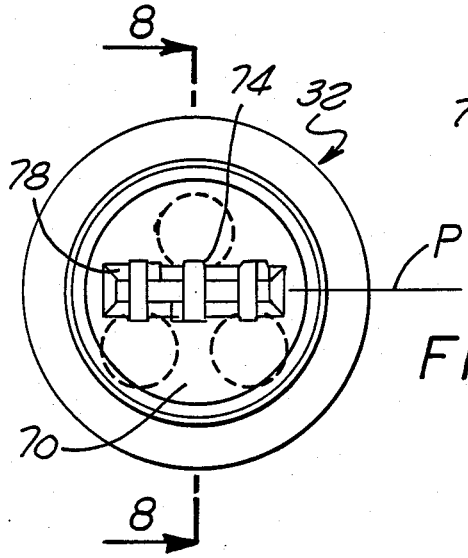
FIG. 7
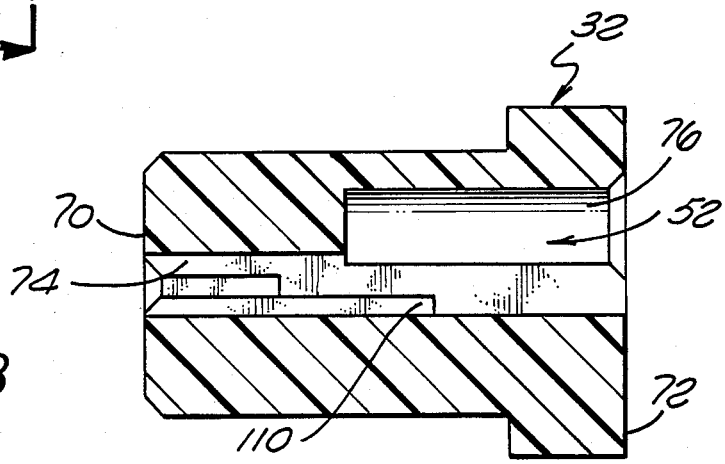
FIG. 8

ELECTRICAL CONNECTOR ADAPTER

BACKGROUND OF THE INVENTION

The present invention relates generally to an electrical connector and, more particularly, to a connector adapter for use in an electrical interconnection system to eliminate the need for interconnecting wires and some contact termination operations.

The present invention will be described as being applicable to an interconnection system for connecting an oxygen sensor assembly exposed to vehicle exhaust to an electronic control unit for the vehicle engine. However, it will be appreciated that the invention could also be used for any other type of electrical interconnection system. A prior electrical interconnection system comprises an oxygen sensor assembly which contains a printed circuit board that is connected to a set of wires by means of a printed circuit board connected mounted on the end of the sensor. The wires are in turn connected to an environmental connector comprising mating plug and receptacle connector members. A typical type of such environmental connector is disclosed in U.S. Pat. No. 3,880,487 to Goodman et al., assigned to the assignee of the present application. Wires lead from the receptacle connector member to a control unit. The use of the wires between the printed circuit board connector in the sensor assembly and the plug connector member in the prior art interconnection system adds considerably to the cost of the system and the assembly of the components. That is, contacts must be crimped to the opposite ends of the wires that extend between the printed circuit board connector and the plug connector member of the environmental connector, which adds substantially to the labor costs for assembling the system.

The reason the wires are required in the prior art system to connect the printed circuit board connector in the sensor assembly and the environmental connector is because the contacts in the printed circuit board connector are arranged in a pattern which is different from the layout of the contacts in the environmental connector, so that the receptacle half of the connector cannot be mated directly to the printed circuit board connector. The printed ciruit board connector and the environmental connector are standard commercial products. It is preferable that standard commercial parts be used to the extent possible in the interconnection system to avoid the cost of redesigning and retooling an entire connector.

It is an object of the present invention to provide an electrical interconnection system of the general type discussed above in which an electrical connector adapter is employed that eliminates the need for the interconnecting wires mentioned above thereby reducing the number of components in the system and the number of contact termination operations that are required. Another object of the invention is to avoid the need for designing and tooling two mating halves of a connector even though the layouts of the contacts in the printed circuit board connector and the environmental connector differ from one another.

SUMMARY OF THE INVENTION

According to a principal aspect of the present invention, there is provided an electrical connector adapter comprising front and rear insulators with contact passages extending therethrough. Each contact passage comprises corresponding cavities in the two insulators which are laterally offset from each other at the junction of the insulators. A contact is mounted in each of the passages. Each contact has first and second contacting end portions mounted in the respective cavities in the front and rear insulators, and an intermediate bendable portion adjacent to the junction of the insulators. One of the insulators is formed of a resilient material. Initially one mating end of each of the contacts is mounted in the cavities in the front insulator. The contact cavities in the rear insulator are then expanded by a special tool which allows the other mating ends of the contacts extending outwardly from the front insulator to be slidably inserted in the cavities in the rear insulator. When the tool is removed from the rear insulator, the walls of the cavities in the insulator contract inwardly around the contacts due to the resilient material of the insulator, thereby automatically bending the intermediate bendable portions of the contacts to accommodate for the lateral offset of the corresponding cavities in the two insulators.

The front and rear insulators of the aforementioned adapter comprise an integral connector assembly forming part of the oxygen sensor assembly in the electrical interconnection system described previously herein. The rear insulator of the assembly formed of resilient material may be one of the connector halves of the standard environmental connector, as previously described herein, modified to make connection to the oxygen sensor, thereby avoiding the need for a set of wires extending from the oxygen sensor assembly to a separate connector assembly and contact crimp operations at the opposite ends of the wires. Further, the present invention allows for the use of a standard environmetal connector half for making electrical connections from the adapter to the engine control unit, thereby avoiding the need of manufacturing a special connector assembly to make such connection.

BRIEF DESCRIPTION OF THE DRAWINGS

FIG. 5 is front isometric view of the adapter illustrated in FIG. 4;

FIG. 6 is a rear isometric view of the adapter illustrated in FIG. 4;

FIG. 7 is a front view of the adapter;

FIG. 8 is a longitudinal sectional view taken along line 8—8 of FIG. 7;

DESCRIPTION OF THE PREFERRED EMBODIMENT

Figure 1:
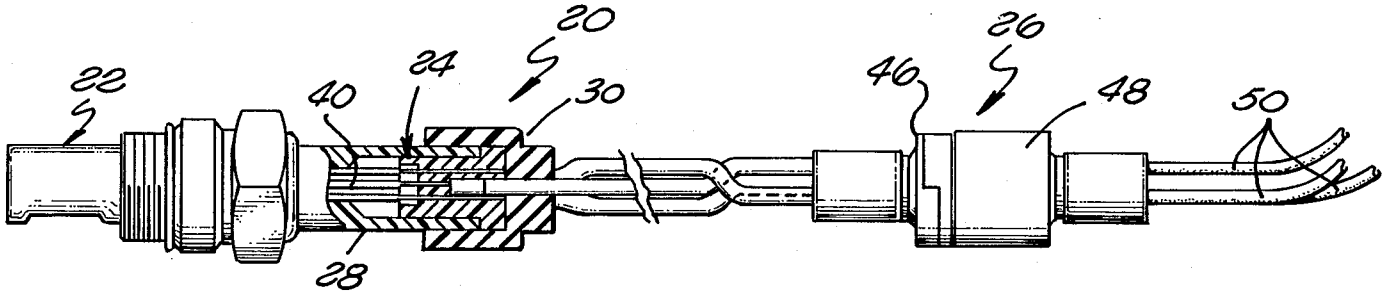
FIG. 1 PRIOR ART
FIG. 1 is a side view, partially in section, of a prior art electrical interconnection system comprising an oxygen sensor assembly, a printed circuit board connector mounted thereon, wires extending from the connector to an environmental connector assembly from which wires extend for connecting to an engine control unit (not shown)
Figure 2:
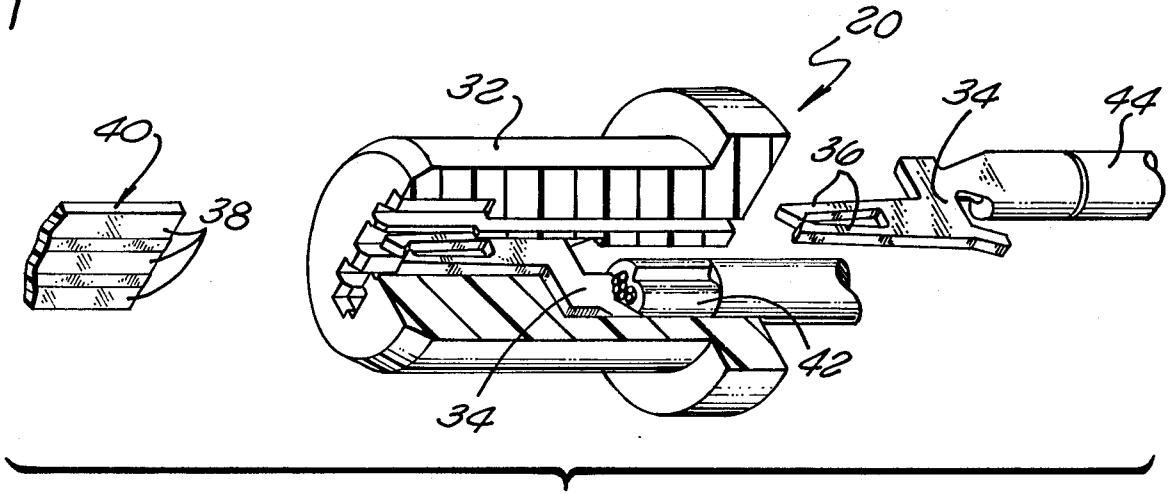
FIG. 2 PRIOR ART
FIG. 2 is an exploded view showing the oxygen sensor assembly printed circuit board, the printed circuit board connector, with one contact mounted in the connector insulator and another contact mounted outside of the insulator, used in the system illustrated in FIG. 1.
Figures 3, 4:
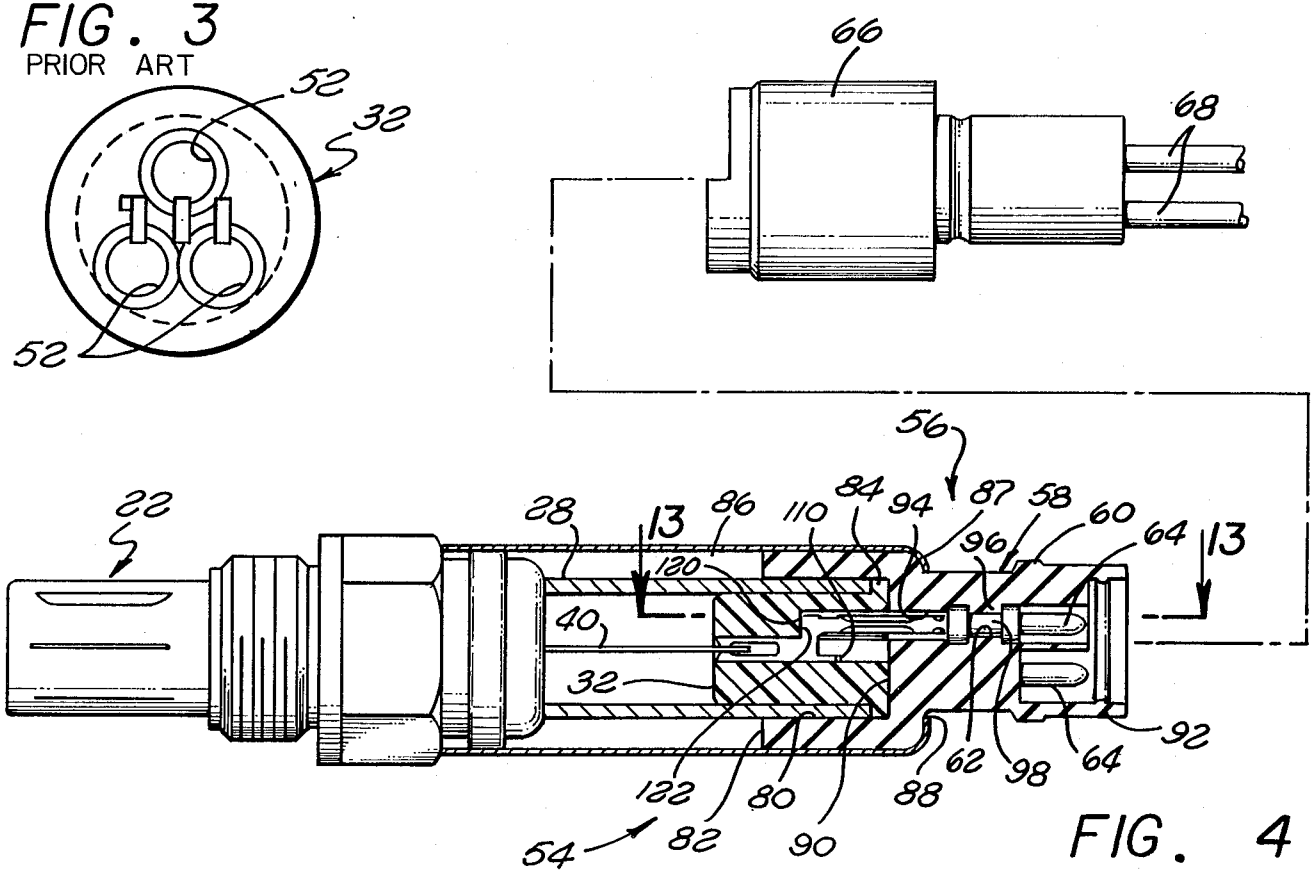
FIG. 3 PRIOR ART
FIG. 3 is a rear view of the printed circuit board connector insulator shown in FIG. 2.
FIG. 4 is a side elevational view, partially in section, of an interconnection system utilizing the electrical connector adapter of the present invention.

Referring first to FIGS. 1–3, there is illustrated a prior art electrical interconnection system, generally designated 20, comprising an oxygen sensor assembly 22, a printed circuit board connector 24 and an environmental connector assembly 26 of the type described in the aforementioned Goodman patent. The connector 24 is mounted on the end of a porcelain sleeve 28 of the sensor assembly 22. An elastomeric boot 30 secures the connector to the sleeve. The connector 24 comprises a rigid plastic insulator 32 containing three contacts 34, only two being seen in FIG. 2. The front portions of the contacts are formed as tuning forks 36 which engage conductive traces 38 formed on the opposite sides of a printed circuit board 40 of the oxygen sensor assembly 22. The rear portions 42 of the contacts are in the form of crimp barrels, which are crimped to insulated wires 44. The opposite ends of the wires 44 are crimped to contacts, not shown, mounted in the plug 46 of the enviromental connector assembly 26. The contacts in the plug 46 mate with corresponding contacts (not shown) in the receptacle 48 of the assembly 26, the latter contacts being connected to wires 50 which extend to an indicator on a dashboard, not shown. As stated previously herein, the connector 26 that has been used in the prior art interconnection system is a standard connector which has a particular layout of contacts. This layout differs from the layout of the contact cavities 52 at the rear of the insulator 32, as seen in FIG. 3. Further, neither the plug nor the receptacle of the connector 26 is configured to mate with the rear of the connector 24 on the sensor assembly. Accordingly, the prior interconnection system requires the interconnecting wires 44 and the mating halves of connector 26 for making a releasable connection between the oxygen sensor assembly and the control unit.

Pursuant to the present invention, there is provided an electrical connector adapter, generally designated 54, which eliminates the need for the wires 44 in the prior interconnection system and the labor cost of terminating contacts at the opposite ends of the wires.

FIG. 4 illustrates an interconnection system 56 incorporating the adapter 54 of the present invention. The system includes the oxygen sensor assembly 22 of FIG. 1. The insulator 32 is the front insulator of the adapter 54. The front insulator is mounted in the porcelain sleeve 28 of the sensor assembly 22 as in the system illustrated in FIG. 1. The adapter 54 also includes rear insulator 58. The front and rear insulators form the insulative body 60 of the adapter. Three contact passages 62 extend lengthwise through the body 60. Contacts 64 are mounted in the passages. The contacts 64 mate with contacts (not shown) in a receptacle connector member 66, which may be identical to the standard commercial receptacle 48 illustrated in FIG. 1. Wires 68 extend from the contacts in the receptacle 66 to the engine control unit, not shown.

Reference is now made to FIGS. 7 and 8 which show in detail the structure of the front insulator 32 of the adapter 54. The three contact cavities 52 extend from the front face 70 to the rear face 72 of the insulator 32. Each cavity comprises a front section or channel 74 that opens at the front face 70 of the insulator, and a rear section 76 that opens at the rear face 72 of the insulator. The front section 74 of each cavity is in the form of a channel having a rectangular cross-section. The rear section 76 of each cavity has a circular cross-section. The front and rear sections of the cavities communicate with each other in the central region of the insulator. As best seen in FIGS. 5 and 7, the channels 74 of the contact cavities extend along a straight row, with their centers lying in a plane P that passes through the center line of the insulator 32. Each of the rear sections 76 of the cavities 52 are disposed radially outwardly from the center line of the insulator, with one cavity rear section 76 being disposed above the the plane P, and the other two rear sections being disposed below the plane, as best seen in FIGS. 3 and 6. The circular rear sections 76 of the cavities 52 are spaced about 120° from each other around the center axis of the insulator. Since the front insulator 32 used in the adapter 54 of the present invention is identical to the insulator 32 used in the prior art system of FIGS. 1 and 2, the rear view illustration of FIG. 3 is also applicable to the insulator illustrated in FIGS. 7 and 8.

A slot 78 is formed in the forward portion of the insulator 32, intersecting the channels 74. The slot is dimensioned to receive the printed circuit board 40 of the sensor assembly 22.

The rear insulator 58 of the adapter 54 is molded of a resilient material, such as silicone rubber. A cylindrical recess 80 opens at the front face 82 of insulator 58. The recess 80 is dimensioned to slidably receive the front insulator 32 and the forward portion of the porcelain sleeve 28 of the oxygen sensor 22. Preferably, an outwardly extending annular flange 84 is formed on the rear of the front insulator 32. This flange has a relatively tight fit with the wall of the recess 80 to assist in holding the front and rear insulators together. A stainless steel hood 86 of the sensor assembly 22 extends over the forward portion of the rear insulator 58, and is formed with a turned-in portion 87 that engages behind a shoulder 88 on the rear insulator. The rear 72 of the front insulator butts up against the bottom 90 of the recess 80 thereby providing a junction or interface between the front and rear insulators where the contact passages 62 extend through the insulative body 60.

The rear portion 92 of the rear insulator is constructed essentially identical to the forward mating portion of the plug connector member 46 of the standard environmental connector assembly 26 illustrated in FIG. 1. Three contact cavities 94 are formed in the rear insulator which communicate with the contact cavities in the front insulator, but are slightly laterally offset therefrom as will be seen later herein. The contacts 64 are retained in the cavities 94 by inwardly extending resilient retention flanges 96 that engage in annular grooves 98 formed in the contact bodies.

Figure 10:
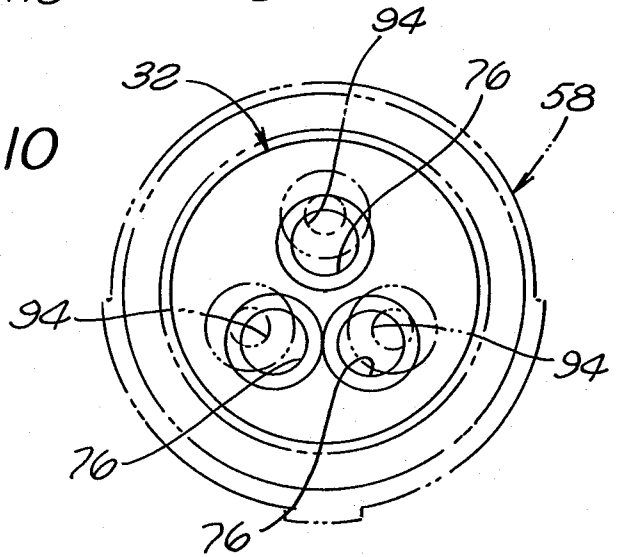
FIG. 10 is an enlarged schematic view showing in phantom the front of the rear insulator of the adaptor and the layout of the contact cavities therein, superimposed over the rear of the front insulator of the adapter showing the layout of the rear sections of the contact cavities in the front insulator offset from the cavities in the rear insulator.

The front insulator 32 of the adapter 54 is an existing part which has previously been used in the prior interconnection system 20 illustrated in FIGS. 1 and 2. Redesign of the component is not desired. Accordingly, the size and location or layout of the rear sections 76 of the contact cavities in the front insulator 32 is predetermined. Likewise, the size and layout of the contact cavities 94 in the rear insulator are predetermined since the rear insulator 58 is designed to mate with a commercially available environmental receptacle connector member 66. As seen in the overlay view of FIG. 10, the layout of the cavities in the front and rear insulators are such that each contact cavity in the rear insulator is laterally offset slightly from the rear section of the corresponding contact cavity in the front insulator. In a commercial embodiment of the present invention, there is an offset or mismatch of about 0.025 to 0.030 inch between the center line of the rear section 76 of the cavity 52 in the front insulator and the center line of the corresponding contact cavity 94 in the rear insulator. As a consequence, the rear portion of contacts 64 mounted in the front insulator cannot be mounted directly into the contact cavities of the rear insulator. However, by use of the novel assembly method to be disclosed later herein, the novel contact structure of the present invention, and by use of a rear insulator formed of a resilient material, the front and the rear insulators and contacts may be assembled together in spite of the fact that the cavities in the two insulators are not aligned with each other.

Figure 9:
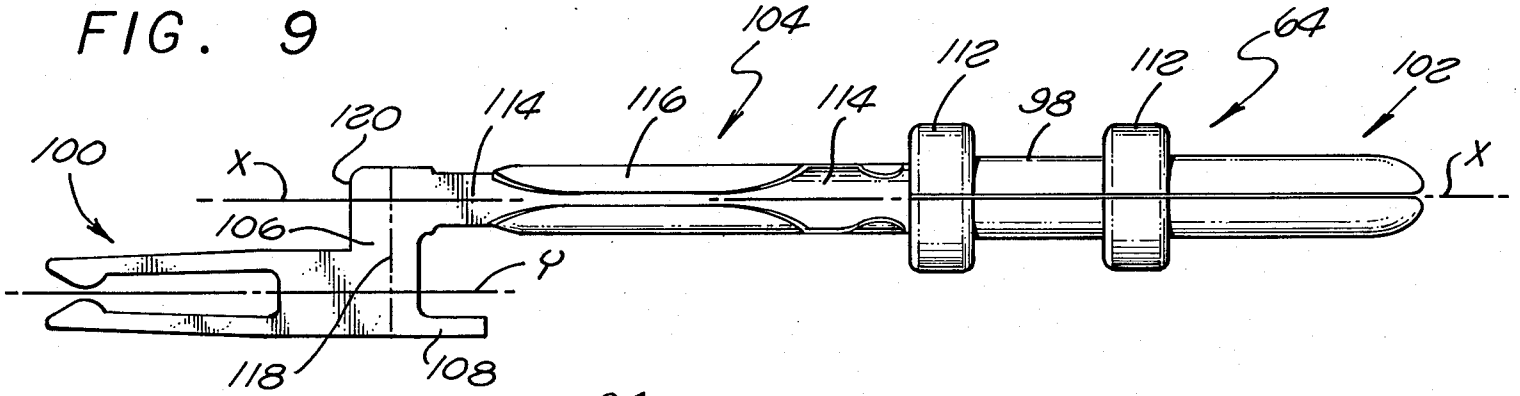
FIG. 9 is a side view of one of the contacts used in the adapter of the present invention.

Reference is now made to FIG. 9 of the drawings which illustrates in detail the contact 64 of the present invention. The contact is stamped and formed from sheet metal. The contact has a first contacting end portion 100, a second contacting end portion 102 and an intermediate bendable portion 104. The second contacting end portion 102 and the intermediate portion 104 of the contact have a common center axis X, which is laterally offset from the center axis Y of the fist contacting end portion 100 by a laterally extending connecting section 106. The first contacting end portion 100 is in the form of a tuning fork contact. The tuning fork contact and the lateral connecting section 106 are essential identical to the forward portions of the prior art contacts 34 seen in FIG. 2. A locking tine 108 extends rearwardly from the tuning fork 100. The tine is bent out of the plane of the tuning fork so that it can engage a forwardly facing shoulder 110 in the contact cavity, as seen in FIG. 4. A similar arrangement is shown in FIG. 2.

The second contacting end portion 102 of the contact is in the form of a pin contact. All three contacts 64 in the adapter of the present invention are formed with pin contacts 102 which are adapted to engage mating socket contacts, not shown, in the receptacle connector 66. This is in contrast to the typical environmental connector 26 illustrated in FIG. 1 wherein there is a mix of pin and socket contacts in the plug and receptacle halves of the connector. Thus, only one style of contact is used in the adapter 54.

The contact body is provided with two enlargements 112 which are spaced apart to define the groove 98 which receives the contact retention flange 96 formed in the wall of the contact cavity. The intermediate portion 104 of the contact is formed with two relatively narrow bendable regions 114. The bendable regions are joined by a generally circular, relatively rigid section 116. Thus, the contact 64 is capable of being bent at the two regions 114.

Since the temperature adjacent to the sensor assembly 22 is relatively high, preferably the tuning fork 100 of the contact is formed of a relatively high temperature alloy, while the remaining portion of the contact on the opposite side of the parting line 118 is formed of a relatively thin, softer material, such a copper. The two parts of the contact may be joined at the parting line 118 by electron beam welding or the like.

Figure 13:
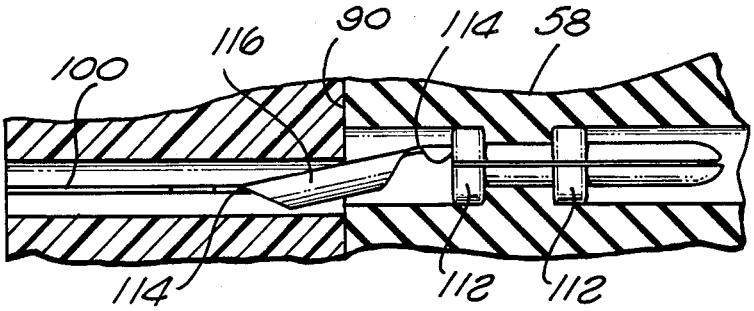
FIG. 13 is a sectional view taken along line 13—13 of FIG. 4 showing the bends formed in the intermediate section of a contact pursuant to the present invention.

The tuning fork portion 100 of the contact is mounted in the front section 74 of the contact cavity 52 in the front insulator while the forward part of the intermediate portion 104 of the contact is disposed in the rear circular section 76 of the contact cavity. The rear part of the intermediate portion 104 of the contact, and the pin contacting end portion 102, are mounted in the contact cavity 94 in the rear insulator. The contacts in the outer channels 74 of the contact cavities are reversed with respect to the contact mounted in the center channel so that the intermediate portions 104 of the contacts will be properly oriented for mounting in the circular rear sections 76 of the contact cavities 52. Such reverse orientation of the contracts is the same as that shown in FIG. 2 for the prior art connector. As best seen in FIG. 13, bends are formed in the regions 114 of the intermediate portion of each contact which allows the contact to accommodate for the lateral misalignment between the contact cavities in the front and rear insulators.

As best seen in FIG. 4, when a contact is mounted in a contact passage 62 in the insulative body 60, the forwardly facing shoulder 120 on the contact engages a rearwardly facing shoulder 122 in the contact cavity 52 in the front insulator to restrict forward movement of the contact in the passage. As stated previously, the locking tine 108 engages a forwardly facing shoulder 110 in the cavity, which restricts rearward movement of the contact in the cavity. The locking tine 108 can be released by inserting a suitable flat tool (not shown) through the channel 74 from the front 70 of the front insulator to deflect the tine away from the shoulder 110 to thereby permit the contact to be removed rearwardly from the contact cavity in the front insulator.

The method of assembling the adapter 54 will now be discussed. First, the forward portions of the contact 64 are mounted in the cavities 52 of the front insulator 32 from the rear face 72 of the insulator. The contacts are pushed into the cavities until the forwardly facing shoulders 120 on the contacts abut the rearwardly facing shoulders 122 in the contact cavities, at which point the locking tines 108 will expand outwardly to locate their ends in front of the shoulders 110. In order to mount the rear portions of the contacts which extend outwardly from the rear face of the front insulator into the contact cavities 94 in the rear insulator, a contact insertion tool of the type disclosed in U.S. Pat. No. 3,955,414 to Anderson, assigned to the assignee of the present application, is used. The Anderson tool is used to mount contacts in the plug and receptacle halves of the environmental connector 48.

Figure 12A:
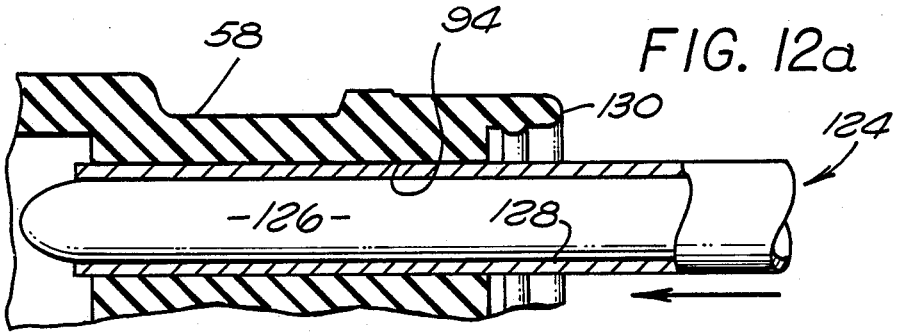
FIGS. 12*a*, 12*b* and 12*c* show the sequence of steps for expanding the cavities in the rear insulator and installing the contacts therein.
Figure 12B:
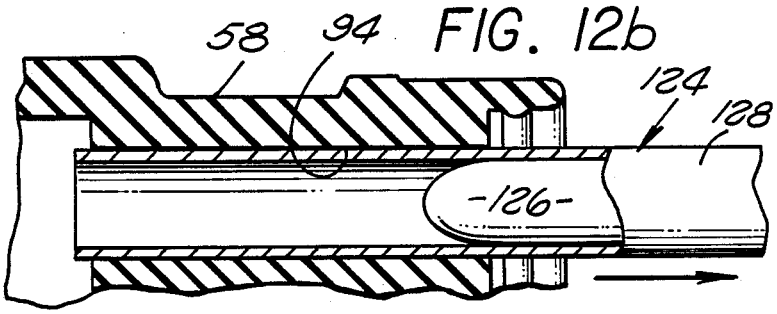
Figure 12C:
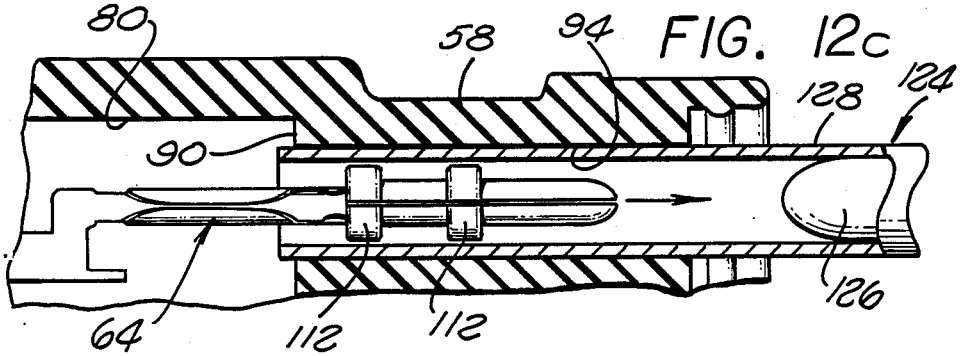

As best seen in FIGS. 12*a* to 12*c*, basically the contact insertion tool, generally designated 124, comprises a pointed pin 126 that is slidably mounted in an outer sleeve 128. The mechanism for actuating the pin and sleeve is disclosed in detail in the aforementioned Anderson patent, which disclosure is incorporated herein by reference. As seen in FIG. 12*a*, initially the pointed tip of the pin 126 of tool 124 is disposed in front of the sleeve 128, and such assembly is pushed into the contact cavity 94 in the rear insulator 58 from the rear 130 of the insulator. In practice, three tools 124 are inserted simultaneously into the contact cavities 94 so that the contacts can be loaded in the cavities at one time. The pointed pin 122 facilitates the insertion of the sleeve 128 in the contact cavity. As seen in FIG. 12*b*, the pins 126 are then retracted rearwardly in the sleeves 124 to permit the rear protuding portions of the contacts 64 in the front insulator to be inserted into the sleeves from the front 82 of the rear insulator, as seen in FIG. 12*c*.

When all three contacts are simultaneously inserted into the tool sleeves 124, the front and rear insulators will become fully assembled as seen in FIG. 4, with the rear face 72 of the front insulator positioned against the bottom 90 of the recess 80 in the rear insulator.

Figure 11:
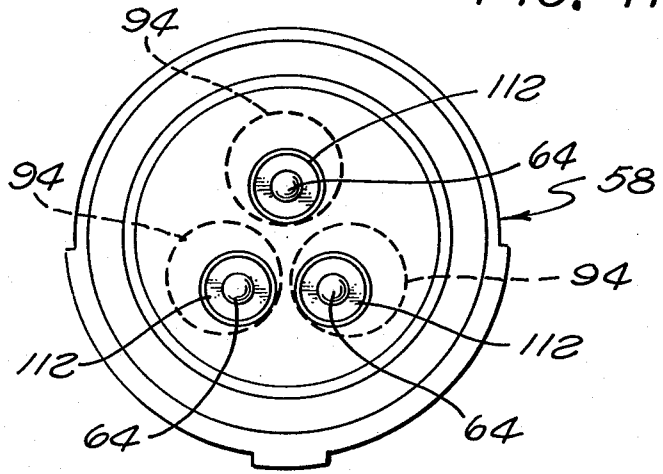
FIG. 11 is similar to FIG. 10 but shows the cavities in the rear insulator expanded by a tool so as to match the contacts extending rearwardly from the cavities in the front insulator.

As in the tool disclosed in the aforementioned Anderson patent, the outer diameter of the sleeve 128 of the tool 124 is sufficiently large to expand the contact retention flange 96 in the cavity 94, while the inner diameter of the sleeve is dimensioned to slidably receive the forward end of the contact 64 therein. However, in contrast to the prior art tool, in the instant invention the inner diameter of the sleeve 128 must be sufficiently large so that the inner circumference of the sleeve will encompass or generally match the diameter and offset position of the enlargements 112 on the rear portion of the contact. As a consequence, in the tool 124 used with the adapter of the present invention, the inner diameter of the sleeve 128 of the tool is greater relative to the diameter of the enlargements 112 of the contact than in the apparatus disclosed in the Anderson patent where there is no lateral offset in the contact cavities in the mating halves of the connector. By way of example only, for a contact having enlargements 112 of a diameter of 0.150 inch, preferably the inner diameter of the sleeve 128 of the tool is 0.185 inch. FIG. 11 shows a comparison between the diameter of the sleeve 128 mounted in the rear insulator, and the pattern of the sleeves mounted in the three contact cavities therein, with respect to the contacts mounted in the cavities in the front insulator.

After the rear portions of the three contacts in the front insulator have been inserted into the sleeves 128 of the tool 124, as shown in FIG. 12*c* for one of the contacts, the sleeves 128 are retracted out of the cavities 94 whereby the elastomeric rear insulator will contract inwardly around the contacts. This will result in the contact retention flanges 96 becoming disposed in the grooves 98 in the contacts to retain the contacts axially within the rear insulator. Further, in accordance with a novel feature of the present invention, due to the resilient force of the rear insulator acting on the contacts with the front and rear insulators assembled as shown in FIG. 4, the contacts will automatically bend at regions 114, as seen in FIG. 13. The bent portions of the contacts accommodate for the lateral misalignment of the cavities in the two insulators at the junction 90 between the insulators. Thus, by the method of the present invention, the contacts do not have to be bent prior to assembly into the front and rear insulators, but instead the contacts are automatically bent to the appropriate configuration simultaneously with withdrawing of the contact insertion tools from the resilient rear insulator. It will, therefore, be appreciated that by the present invention the cost of manufacturing and assembly of the adapter 54 is relatively low. Further, by the use of the adapter of the present invention, the wires 44 used in the prior art interconnection system 20 illustrated in FIG. 1 are eliminated, as well as the cost of terminating contacts to such wires. By use of the special rear insulator and contacts of the present invention, the rear insulator may be assembled with the presently existing front insulator, and the rear insulator can be mated with a standard environmental receptacle connector member 66, thereby minimizing the overall expense of the interconnection system.

Although one embodiment of the invention has been disclosed herein for purposes of illustration, it will be understood that various changes can be made in the form, details, arrangement and proportions of the various parts in such embodiment without departing from the spirit and scope of the invention as defined by the appended claims.

What is claimed is:

1. An electrical connector adapter comprising:

an insulative body comprising first and second parts;

at least two contact passages extending lengthwise through said first and second parts, each said passage comprising a cavity in said first part communicating with a corresponding cavity in said second part;

each said cavity in said first part being laterally offset from its corresponding cavity in said second part at the junction of said parts;

a contact mounted in each of said passages;

each said contact having first and second contacting end portions and an intermediate bendable portion;

each said contact in each of said passages having said first contacting portion positioned in said cavity in said first part and said second contacting portion positioned in said cavity in said second part, said intermediate portion of said contact having a bend therein adjacent to said junction; and one of said parts being formed of a resilient material, said material having sufficient resilience to create said bend in said intermediate portion of each said contact by resilient engagement of the wall of the corresponding cavity in said one part with said contact.

2. An electrical connector adapter as set forth in claim 1 wherein:

said intermediate portion of each said contact has two bends therein on opposite sides of said junction.

3. An electrical connector adapter as set forth in claim 1 wherein:

said first part is formed of a relative rigid plastic; and said second part is formed of an elastomeric material.

4. An electrical connector adapter as set forth in claim 1 wherein:

said first contacting portion of each said contact is offset from the center axis of said second contacting portion.

5. An electrical connector adapter as set forth in dlaim 1 wherein:

at least three contact passages are provided in said body thereby providing at least three cavities in said first part and at least three corresponding cavities in said second part;

each said cavity in said first part having a front section and a rear section;

said front sections of said cavities in said first part being arranged in a straight row; and said cavities in said second part are arranged in a pattern other than a straight row.

6. An electrical connector adapter as set forth in claim 5 wherein:

said rear sections of said cavities in said first part are arranged in a pattern similar to but different from said pattern of said cavities in said second part so that each said cavity rear section is laterally offset from its corresponding cavity in said second part.

7. An electrical connector adapter as set forth in claim 6 wherein:

said intermediate portion and second contacting portion of each said contact extend generally along one axis and said first contacting portion is laterally offset from said axis.

8. An electrical connector adapter as set forth in claim 7 wherein:

said intermediate portion of each said contact is mounted in the rear section of its corresponding cavity in said first part; and said first contacting portion of each said contact is mounted in the front section of its corresponding cavity in said first part.

9. An electrical connector adapter as set forth in claim 6 wherein:

said first part is formed with a printed circuit board receiving slot extending lengthwise of said row and intersecting said front sections of said cavities in said first part; and said contacting end portions of said contacts in said cavities in said first part are located in said front sections of said cavities and are arranged to engage a printed circuit board mounted in said slot.

10. An electrical connector adapter as set forth in claim 9 wherein:

said contacting end portions of said contact in said front sections of said cavities in said first part are tuning fork contacts.

11. An electrical connector adapter comprising:

an insulative body comprising first and second parts;

at least two contact passages extending lengthwise through said first and second parts, each said passage comprising a single cavity in said first part communicating with a corresponding single cavity in said second part;

said cavities in said first part being located in a single plane passing through the center axis of said body;

said cavities in said second part being disposed on opposite sides of said plane so that the cavity of each passage in said first part is offset from the corresponding cavity of said passage in said second part;

a contact mounted in each of said passages;

each said contact having first and second contacting end portions and an intermediate bendable portion, said first contacting portion being offset from the center axis of said second contacting portion; and each said contact in each of said passages having said first contacting portion positioned in said cavity in said first part and said second contacting portion positioned in said cavity in said second part, said intermediate portion of said contact having a bend therein adjacent to the junction of said first and second parts, said bend extending in a direction transverse to the length of said contact.

12. An electrical connector adapter as set forth in claim 11 wherein:

one of said parts is formed of a resilient material, said material having sufficient resilience to create said bend in said intermediate portion of each said contact by resilient engagement of the wall of the corresponding cavity in said one part with said contact.

13. An electrical connector adapter comprising:

an insulative body comprising first and second parts;

at least three contact passages extending lengthwise through said first and second parts, each said passage comprising a cavity in said first part communicating with a corresponding cavity in said second part, said cavities in said first part being arranged in a straight row;

said cavities in said second part being disposed in a pattern other than a straight row so that the cavity of each passage in said first part is offset from the corresponding cavity of said passage in said second part;

a contact mounted in each of said passages;

each said contact having first and second contacting end portions and an intermediate bendable portion, said first contacting portion being offset from the center axis of said second contacting portion; and each said contact in each of said passages having said first contacting portion positioned in said cavity in said first part and said second contacting portion positioned in said cavity in said second part, said intermediate portion of said contact having a bend therein adjacent to the junction of said first and second parts.

14. An electrical connector adapter as set forth in claim 13 wherein:

one of said parts is formed of a resilient material, said material having sufficient resilience to create said bend in said intermediate portion of each said contact by resilient engagement of the wall of the corresponding cavity in said one part with said contact.

15. A method of assembling a connector comprising first and second insulative parts having contact cavities therein each laterally offset from a corresponding cavity in the other part, and contacts each having first and second contacting portions and an intermediate bendable portion, said second insulative part being formed of a resilient material, comprising the steps of:

inserting the first portions of said contacts into said cavities in said first part so that said second portions extend outwardly from said cavities;

applying a force to the walls of the cavities in said second part sufficient to expand said cavities so that they substantially match the positions of said second portions of said contacts;

inserting said second portions of said contacts into said cavities in said second part while said cavities are expanded; and removing said expansive force to allow the walls of said cavities to resiliently contract around said second portions of said contacts and automatically bend said intermediate portions of said contacts to accommodate for the lateral offset of the corresponding cavities in said parts.

* * * * *